United States Patent [19]

Krubsack

[11] 3,976,424

[45] Aug. 24, 1976

[54] REFRACTORY ROOF CONSTRUCTION FOR THE HEATING CHAMBER OF AN INDUSTRIAL FURNACE

[75] Inventor: Kim R. Krubsack, Watertown, Wis.

[73] Assignee: Sola Basic Industries, Inc., Milwaukee, Wis.

[22] Filed: Feb. 18, 1975

[21] Appl. No.: 550,229

[52] U.S. Cl. ..... 432/247; 432/252; 110/99 R; 13/35

[51] Int. Cl.[2] ..... F23M 5/02; F27D 1/02

[58] Field of Search ..... 432/238, 247, 250, 252, 432/233; 13/35; 110/1 B, 1 L, 99 R; 52/89

[56] References Cited

UNITED STATES PATENTS

| | | | |
|---|---|---|---|
| 1,440,468 | 1/1923 | Kanagy et al. | 110/99 R |
| 1,686,761 | 10/1928 | Norton | 110/99 R |
| 2,319,065 | 5/1943 | Karmanocky | 432/252 |
| 2,359,619 | 10/1944 | Callaway | 110/99 R |
| 2,611,330 | 9/1952 | Kirk | 110/99 R |
| 3,198,147 | 8/1965 | Usmiani et al. | 52/89 |
| 3,756,172 | 9/1973 | Brereton et al. | 110/99 R |
| 3,807,944 | 4/1974 | Kranjcich et al. | 432/247 |

FOREIGN PATENTS OR APPLICATIONS

| | | | |
|---|---|---|---|
| 767,700 | 3/1953 | Germany | 432/252 |
| 448,663 | 6/1936 | United Kingdom | 110/1 B |

*Primary Examiner*—John J. Camby
*Assistant Examiner*—Henry C. Yuen
*Attorney, Agent, or Firm*—Smythe & Moore

[57] ABSTRACT

The roof of an elongated heating chamber of a refractory walled industrial furnace includes a plurality of transverse rafters which are spaced along the chamber, and each rafter is formed of a pair of arch bricks and an arch key brick between the inner ends thereof. A plurality of longitudinally extending roof bricks are supported between successive rafters by the means of notches in the ends of the roof bricks which rest upon horizontal surfaces defined on the central portion of each rafter.

4 Claims, 7 Drawing Figures

FIG. 3
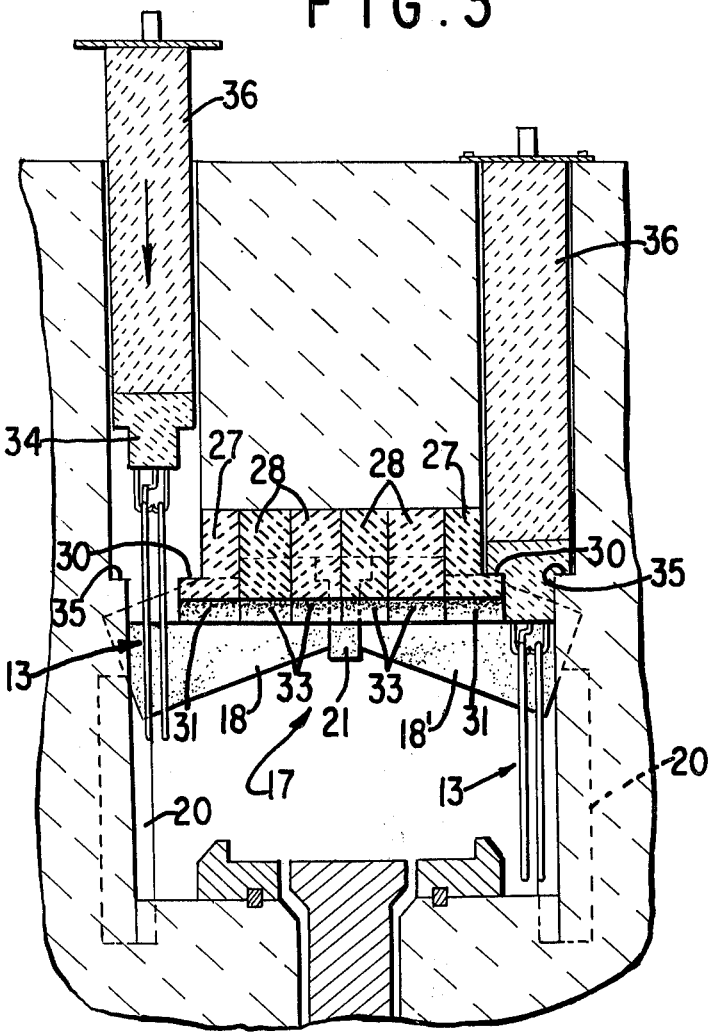
FIG. 4
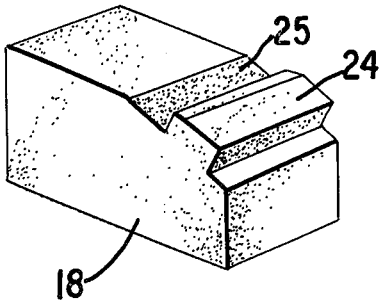
FIG. 5
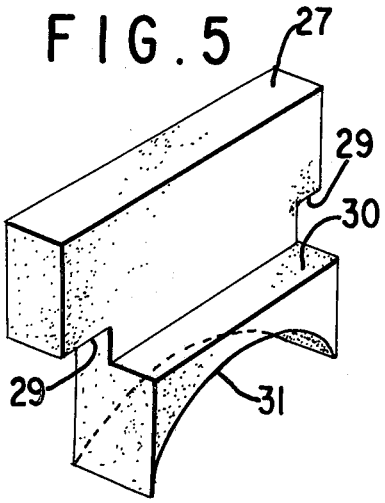
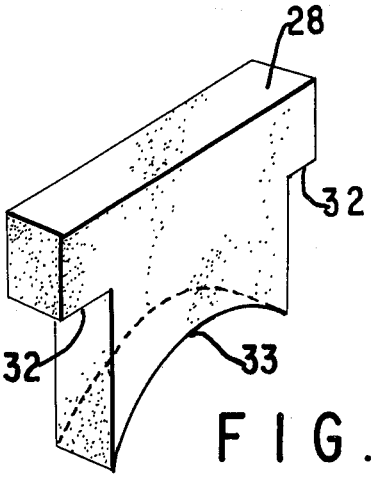
FIG. 7
FIG. 6
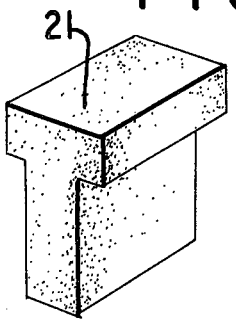

REFRACTORY ROOF CONSTRUCTION FOR THE HEATING CHAMBER OF AN INDUSTRIAL FURNACE

The present invention relates to the refractory wall and roof construction for an industrial furnace, and more particularly, to the formation of an arch in the roof of the heating chamber of such a furnace.

An industrial furnace of the type having an elongated hearth as heating chamber extending therethrough is conventionally constructed of a plurality of specially shaped refractory brick. The roof of the chamber is generally formed in the shape of an arch which is constructed by the use of specially designed brick so as to form an arch of high strength. The formation of such an arch is particularly important in the case of high temperature industrial furnaces.

One form of such an arch comprises a plurality of rafters with each rafter consisting of a pair of arch bricks with a T-shaped arch key brick between the inner ends of the arch bricks. The arch bricks are inclined upwardly at an angle and the ends thereof are received in notches formed in slabs defining the side walls of the chamber. The weight of the arch tends to maintain the arch in position. The notched sidewalls of the chamber formed of a very dense high temperature refractory provide a construction which is very strong mechanically. When the same arch construction was employed for a furnace incorporating a replaceable heating element which was insertable and removable through the top of the furnace, certain difficulties were encountered. If an opening were made through the roof members, such would result in uneven sections of high temperature refractory which would quickly lead to fractures and possible deterioration of the construction.

One of the objects of the present invention is to provide an improved refractory roof construction for the heating chamber of a high temperature furnace for accommodating replaceable heating elements insertable and removable from the top of the furnace.

Another of the objects of the invention is to provide such an arch which is mechanically strong, can be readily installed, and is reliable over long periods of operation while at the same time readily accommodating replaceable heating elements.

According to one aspect of the present invention a refractory construction for the roof of an elongated hearth, heating chamber or tunnel of an industrial furnace may comprise a plurality of transverse rafters across the chamber and spaced longitudinally therealong. Each rafter comprises a pair of arch bricks and an arch key brick between the inner ends thereof. A plurality of longitudinally extending roof bricks are positioned between successive rafters such that the ends of the roof bricks rest upon horizontal surfaces defined on the rafters.

Other objects, advantages and features of the present invention will become apparent from the accompanying description and drawings, which are merely exemplary.

In the drawings:

FIG. 3 is a sectional view taken along the line 3—3 of FIG. 1; and

FIGS. 4 through 7 are perspective views of the refractory bricks used in forming the refractory roof construction according to the present invention.

Proceeding next to the drawings wherein like reference symbols indicate the same parts throughout the various views, a specific embodiment of the present invention will be described in detail.

Figure 1:
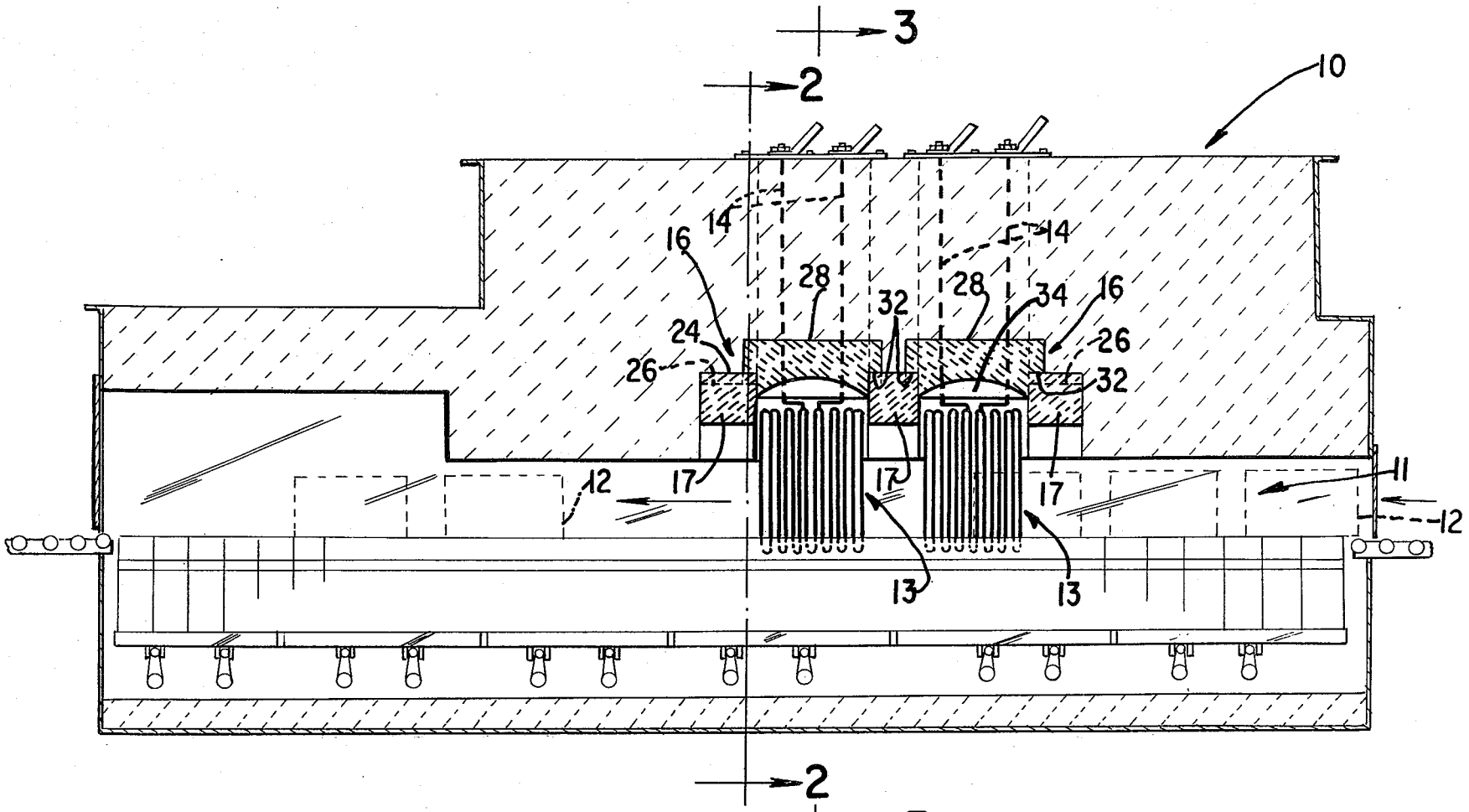
FIG. 1 is a vertical longitudinal sectional view of the refractory roof construction of an industrial furnace according to the present invention.

In FIG. 1, there is indicated generally at 10 a high temperature industrial furnace having an elongated hearth or furnace chamber 11 extending longitudinally therethrough and through which work pieces which are to be heat treated are conveyed in suitable containers 12. In the central portion of the elongated chamber or tunnel is the heating portion comprising a plurality of heating elements 13 which may be positioned on both sides of the chamber adjacent the side walls thereof. The heating elements are connected to electrical leads 14 which extend upwardly through openings in a plugged element 34 which is supported in the roof of the hearth. The arched construction of the present invention is indicated generally at 16 and comprises a plurality of rafters 17 which extend transversely across the chamber in the roof thereof.

Figure 2:
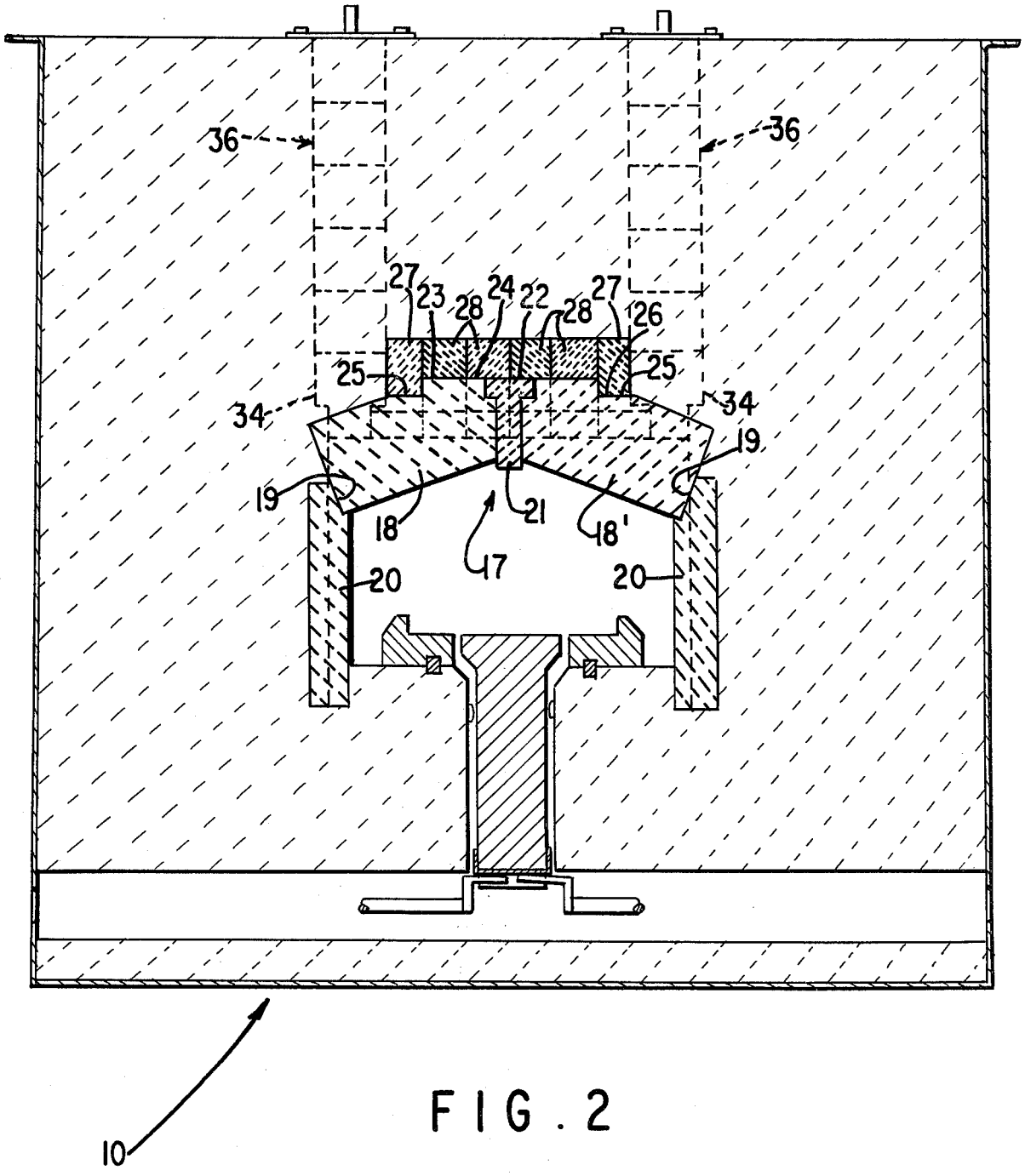
FIG. 2 is a sectional view taken along the line 2—2 of FIG, 1.

As may be seen in FIG. 2, each rafter 17 comprises a pair of roof bricks 18 and 18' extending upwardly at an angle toward the center of the roof. The outer ends of the roof bricks 18 are supported in notches 19 formed in the side wall slabs 20 of the chamber. The inner ends of the roof bricks 18 are notched to accommodate a T-shaped arch key brick 21 in such a manner that the upper face 22 of the arch key brick and adjacent upper surface portions 23 of the roof bricks define a first horizontal surface 24.

The upper surface of each roof brick 18 is further provided with a notch 25 adjacent the horizontal surface 24 so as to define a second horizontal surface 26 which is lower than the horizontal 24.

The space between successive spaced rafters 17 is filled by a plurality of longitudinally extending roof bricks such as 27 shown in FIG. 5 and 28 shown in FIG. 7. The roof bricks 27 are at the outer edge and each consists of longitudinal notched portions 29 and a longitudinally extending horizontal shoulder 30. The underside of the roof brick 27 has a concave surface 31 so as to define a curved portion or arch.

The longitudinally extending roof bricks 28 also have longitudinal notches 32 therein and the underside thereof has a concave surface 33.

When the roof bricks 27 and 28 are assembled as shown in FIGS. 2 and 3, the roof surface between adjacent rafters is formed with a curved arch surface. The notched ends 32 of the bricks 28 rest upon the horizontal surfaces 24 on successive rafters and the notched ends 29 of the roof bricks 27 rest upon the horizontal surfaces 26 which are at a lower level.

As can be seen in FIGS. 2 and 3, the outer roof bricks 27 of each roof section between successive rafters are spaced from the side wall slabs 20 of the chamber. Into this space there is inserted a ceramic plug element 34 having a notched underside which rests upon the shoulder 30 and a second notched underside which rests upon a suitable shoulder 35 formed in the wall of the refractory chamber. The heating element 13 is supported from the underside of the plug element 34 in a manner known in the art and the leads extend upwardly therethrough through successive removable bricks as indicated at 36 in FIGS. 2 and 3. The removable unit 36 may either comprise a plurality of refractory bricks as indicated in FIG. 2 or a single unit as shown in FIG. 3.

The positioning of the plug elements 34 as shown herein provides a furnace or chamber roof which has sufficient strength to support the heating elements and at the same time contains the heat generated within the chamber. In addition, the removal and replacement of the heating elements is greatly facilitated by this construction. The insertion of the heating element is shown in greater detail in FIG. 3 where the removable unit 36 is being inserted into position. As a result of this construction, the furnace can be readily operated at a temperature of about 1650°C. The details of an example of a removable heating element is shown in copending application Ser. No. 550,291, filed Feb. 18,1975.

It will be understood that various details of construction and arrangement of parts may be made without departing from the spirit of the invention except as defined in the appended claims.

What is claimed is:

1. In a refractory construction for the roof of an elongated heating chamber of an industrial furnace, said chamber having vertical side walls on each side of said chamber, the combination of a plurality of transverse rafters extending across said chamber and spaced from each other longitudinally along said chamber, each rafter comprising a pair of arch bricks, each sloping upwardly toward the longitudinal centerline of said chamber, each of said arch bricks having an outer end engaging and held by its respective side wall, said arch bricks having inner ends adjacent said centerline, an arch key brick for each rafter located between said inner ends of its respective arch bricks and engaged thereby, and a plurality of roof bricks extending longitudinally of said chamber between successive rafters, said roof bricks having ends resting on and supported by the pair of rafters between which it extends, said roof bricks having an outer one on each side of said chamber, said arch key brick has a top surface which with the inner ends of said arch bricks define a first horizontal surface and there is a notch in the upper surface of each outer roof brick adjacent said first horizontal surface which defines a second horizontal surface lower than said first horizontal surface.

2. In a refractory construction as claimed in claim 1, wherein each roof brick has a lower surface which is a concave surface to define an arch extending between successive rafters.

3. In a refractory construction for the roof of an elongated heating chamber of an industrial furnace, said chamber having vertical side walls on each side of said chamber, the combination of a plurality of transverse rafters extending across said chamber and spaced from each other longitudinally along said chamber, each rafter comprising a pair of arch bricks, each sloping upwardly toward the longitudinal centerline of said chamber, each of said arch bricks having an outer end engaging and held by its respective side wall, said arch bricks having inner ends adjacent said centerline, an arch key brick for each rafter located between said inner ends of its respective arch bricks and engaged thereby, and a plurality of roof bricks extending longitudinally of said chamber between successive rafters, said roof bricks having ends resting on and supported by the pair of rafters between which it extends, said roof bricks having an outer one on each side of said chamber, said outer ones of the roof bricks between each pair of rafters being spaced from the side walls of the chamber to define a space into which a removable electrical element supporting plug is located between said outer ones of said roof bricks and the respective side wall.

4. In a refractory construction as claimed in claim 3, wherein the outer ends of said arch bricks have an aperture therethrough for receiving said plug and the outer face of each of said outer ones of said roof bricks has a longitudinally extending horizontal shoulder thereon upon which said plug element can be supported.

* * * * *